United States Patent [19]

Doty

[11] Patent Number: 4,806,170

[45] **Date of Patent: * Feb. 21, 1989**

[54] METHOD FOR PROVIDING ACCESS TO UNDERGROUND VALVE STEMS AND TOOL

[76] Inventor: John T. Doty, 2238 E. 21st St., Long Beach, Calif. 90806

[ * ] Notice: The portion of the term of this patent subsequent to Jul. 22, 2003 has been disclaimed.

[21] Appl. No.: 928,565

[22] Filed: Nov. 10, 1986

[51] Int. Cl.[4] ..... B08B 7/00

[52] U.S. Cl. ..... 134/9; 7/138; 134/8; 134/22.1

[58] Field of Search ..... 134/8, 9, 22.1, 22.11, 134/32, 33; 7/116, 138, 142, 158, 170; 175/315, 404; 251/291, 293; 15/104.09, 104.16; 81/121.1; 166/311

[56] References Cited

U.S. PATENT DOCUMENTS

| | | | |
|---|---|---|---|
| 876,675 | 1/1908 | Albrecht | 7/138 |
| 1,807,625 | 6/1931 | Hjorth | 7/158 |
| 1,945,304 | 1/1934 | Beagle | 7/142 |
| 3,123,163 | 3/1964 | Overby | 175/40 X |
| 3,715,168 | 2/1973 | Kuhn | 81/121.1 |
| 3,854,727 | 12/1974 | Alexander | 175/315 |
| 4,601,077 | 7/1986 | Doty | 7/138 |

*Primary Examiner*—Frederick R. Schmidt
*Assistant Examiner*—Robert Showalter
*Attorney, Agent, or Firm*—Evanns & Walsh

[57] ABSTRACT

A method for obtaining access to the end of a valve stem of a valve in a buried water main having a gate can extending from the valve to the surface. The gate can may be filled with debris or other material which has become solidified so that it cannot be removed with a known type of tool. An additional or accessory tool is provided having a blade which can be inserted into the gate can and utilized to break up, granulate or pulverize the material in the gate can. The accessory tool is operated by a manual operating tool. After the material has thus been broken up, a second tool is used which is of a type which can be inserted into the gate can and operated to collect the granulated or pulverized material and to remove it from the gate can. Both of the tools can be operated by a single manual operating tool or instrumentality having an extensible handle and which is also usable to operate a nut at the end of the valve stem after access has been obtained.

9 Claims, 2 Drawing Sheets

FIG 1
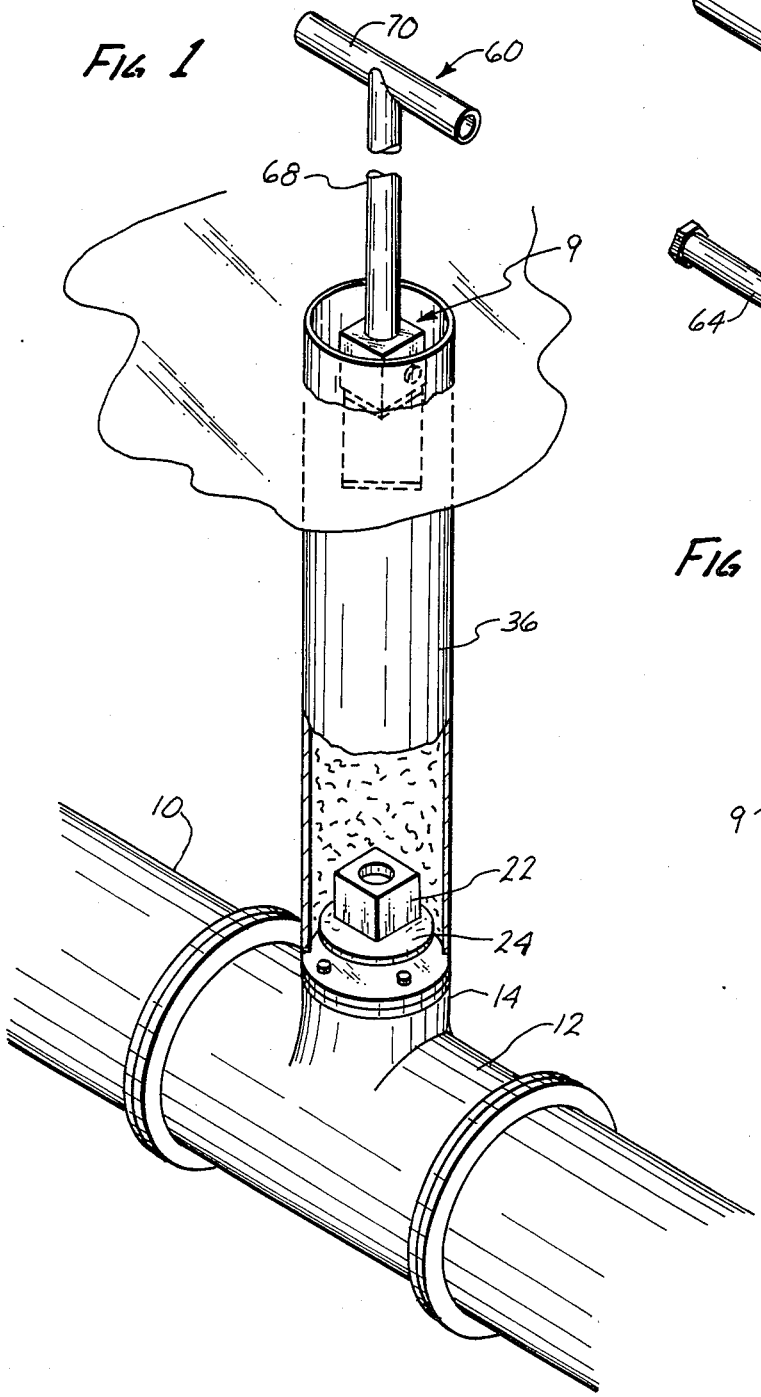
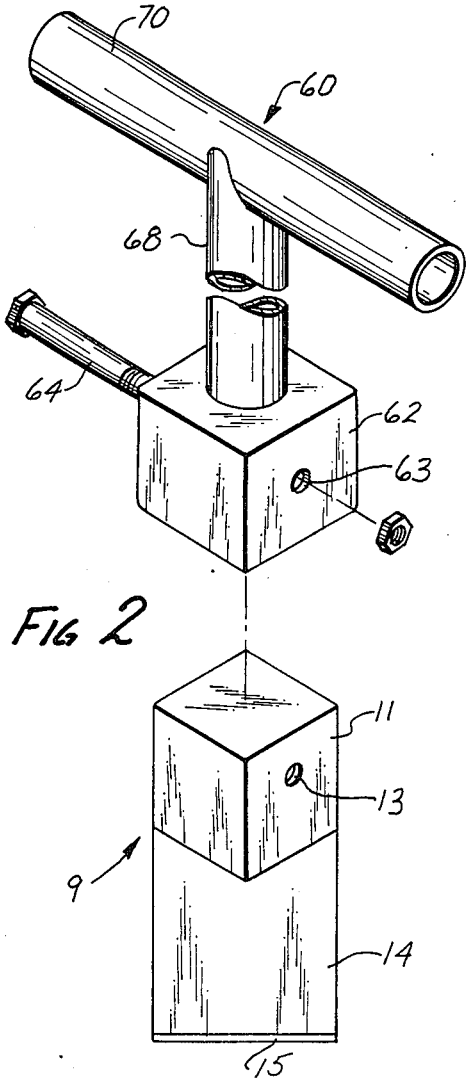
FIG 2

METHOD FOR PROVIDING ACCESS TO UNDERGROUND VALVE STEMS AND TOOL

BACKGROUND OF THE INVENTION

1. Field of the Invention

The field of the invention is particularly related to the following. All water companies, large and small, have miles of water lines buried in the streets and right of ways in order to serve their customers. Included in these miles of pipelines there are hundreds, if not thousands, of valves, typically, gate valves to control the flow of water, in their systems. The valves are typically installed in pipelines that are buried from three to ten feet under the surface approximately. The herein invention is concerned primarily with a method of gaining access to these valves with tools, all as described more in detail hereinafter.

2. Description of the Prior Art

As set forth in the foregoing relating to the field of the invention, it is concerned with valves that are buried underground in water lines. Typically, these valves are gate valves, although there can be valves of other types. Typically, when these valves are installed, they are installed with a cylindrical enclosure called a gate can, the lower end of which is the same size as the valve bonnet and the other end of which extends to the surface and which is provided with a closure at the surface. By removing the closure or lid on the enclosure or gate can and using a special T-handled socket wrench or tool, a maintenance man can normally quickly gain access to the end of the valve stem of the buried valve and operate it to turn it on and off. This can be done provided that the enclosure, that is, the gate can, is not filled with silt, sand, road-base material, solidified material, or other debris which prevents access to the operating end of the valve stem.

As well-known in the prior art, when a water line becomes broken, very serious damage can result from water gushing out of the break and flooding adjacent residences or other buildings, doing substantial damage to properties, such as rugs and other appurtenances. What happens frequently is that emergency crews have difficulty finding the valves and even greater difficulty obtaining access to the operating stems of the valves because the enclosures or gate cans become filled up, as described in the foregoing. Typically, great difficulty is experienced in digging out or extracting debris from the enclosure or gate can which, of course, delays the time before the emergency can be corrected, and the valve or valves are shut off to stop water coming out of the break.

The problem outlined in the foregoing has been met to a considerable degree by way of the tool disclosed in the herein inventor's U.S. Pat. No. 4,601,077.

It has been found, however, that a further method and additional accessory tool are needed in certain circumstances. The maintenance crews may encounter material within the gate can which is solidified, that is, it has become so solid that it cannot be extricated with the tool of the issued patent. In these circumstances, what frequently happens is that the maintenance crews call for a helper to bring a sledgehammer, and the helper pounds on the handle of the tool with the sledgehammer, trying to cause it to extricate this material that is solid. This deforms the handle of the tool and could, of course, destroy the tool itself after excessive pounding.

Thus, it has been found that a method embracing an additional tool is needed, and a preferred form of such a method and tool adapted to the identified purpose is described in detail hereinafter. The detailed disclosure hereinafter describes a method of meeting the problem as identified in the foregoing, including that problem, where the material in the gate can has been solidified, the method involving steps including the utilization of the tool as described hereinafter, as well as the tool of the issued U.S. Pat. No. 4,601,077.

SUMMARY OF THE INVENTION

The invention comprises a method, that is, a series of steps, using tools as described herein, whereby access may be had to the end of the valve stem at the bottom of a gate can in which debris or other material has become solidified.

Typically, a gate can may have a size which is in the range of 6 inches to 12 inches in diameter, depending of course upon the size of the water main and valve with which it is operated.

The method of the invention comprises a series of steps using two different tools, one of them being the tool shown in U.S. Pat. No. 4,601,077.

The initial tool to be used in a situation where the material in the gate can has become solidified is a tool including a fitting having extending from it preferably a straight cutting blade having a cutting edge at its end. Preferably, the fitting or part from which the blade extends is square, which is adapted to be received in a square socket at the end of a manual operating tool.

Typically, the valve in question, such as a gate valve, has an operating stem at the end of which is an operating fitting, typically in the form of a square nut which can receive a square socket at the end of the operating tool, which extends to the surface. From the foregoing, it is to be seen that the tool, as described, can be inserted into the gate can, either along the center line of the gate can or offset from the center, and then by applying pressure and rotating, the material in the gate can can be granulated or reduced to a particulate condition. After the tool, as described, has been used to do its job of granulating solid material in the gate can, then the second tool is used, which is the one shown in detail in U.S. Pat. No. 4,601,077. This tool has a cylindrical part, on the outside of which is a helical rib of a size such that the rib will fit into the enclosure, that is, the gate can. At the lower end of the rib is a generally radial cutting edge which is substantially at the level of the bottom end of the cylindrical bore in the tool. By rotating the tool, using the same operating handle or tool as used with the previously described tool, it can collect particulate debris within the gate can that it can be pulled out and removed. The hollow end of this second tool can come down over the operating nut at the end of the operating stem of the valve so that all of the debris can be removed, providing for free and ready access to the nut at the end of the operating stem of the valve.

From the foregoing, it can be seen that the method as provided, includes the steps of first using the first-described tool to granulate or pulverize the solidified material within the gate can, and then using the second tool as shown in U.S. Pat. No. 4,601,077 for removing the granulated material from the gate can. As can be seen, the invention provides a series of steps wherein an operating tool or handle is utilized, first with one tool, and then with the other tool, the operating handle being the same one that is used to engage and turn the nut at the end of the valve stem.

In light of the foregoing, the primary object of the invention is to provide and make available a method along with the necessary tools for obtaining access to an underground valve having an operating fitting at the bottom of a gate can which may become filled with solidified debris or other material.

A further object is to provide an additional tool having an operating blade so constructed that the tool has the capability of cutting into and granulating or pulverizing solidified material within a gate can.

A further object is to provide a method for the purpose identified, the method using a first tool having a cutting blade and cutting into and granulating pulverized material which has become solidified in a gate can, and then following with the further step of using a tool in the gate can constructed for the purpose of engaging and holding the particulate material so that it can be removed from the gate can by withdrawing the tool.

A further object is to provide a method as in the foregoing wherein the second tool is a type of tool which can be inserted into the gate can and which has the capability of engaging particulate material and holding it so that the material can be removed by withdrawing the tool from the gate can.

BRIEF DESCRIPTION OF THE DRAWINGS

FIG. 1 is a pictorial view illustrating a preferred form of the tool of the herein invention and its utilization;

FIG. 2 is an isometric view of the tool itself of FIG. 1 and an operating tool having a handle with a fitting for turning the tool.

DESCRIPTION OF A PREFERRED EMBODIMENT AND BEST MODE OF PRACTICE OF THE INVENTION

Figure 3:
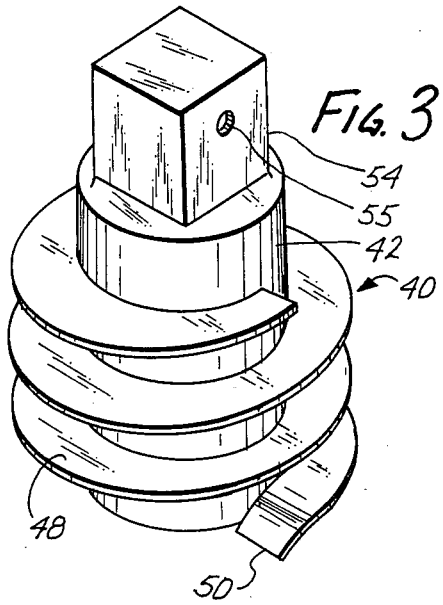
FIG. 3 is an isometric view of the tool of U.S. Pat. No. 4,601,077.

Referring to the drawings, FIG. 1 is a pictorial view showing a buried water pipeline 10, valve and gate can. The line has a section 12 which has a valve in it which in the present embodiment is a gate valve, the valve having a bonnet 14. The valve has a stem 20 as may be seen in FIG. 5 at the upper end of which is a square fitting 22 above a disc 24 which is at the end of the stem 20 and underneath the square part 22. Numeral 28 designates a disc spaced from the valve bonnet 14 and which is attached to the bonnet or the top of the valve by cap screws or bolts, such as shown at 32. Normally, a gasket or a sealing member is provided between the top of the valve bonnet and the disc 28 (not shown).

The gate can or enclosure is identified by numeral 36, as shown in the figures. The lower end of it comes down over the disc 28 and may be secured to it by welding. This enclosure, as shown, is normally cylindrical and extends to the surface, and the tp end is normally closed by a removable enclosure or cap (not shown). As described in the foregoing, frequently the gate can or enclosure 36 becomes filled with silt, dirt, or other debris so that access cannot be had to the fitting 22 which is a square fitting adapted to receive a square socket at the end of an operating handle, as will be described.

Figure 4:
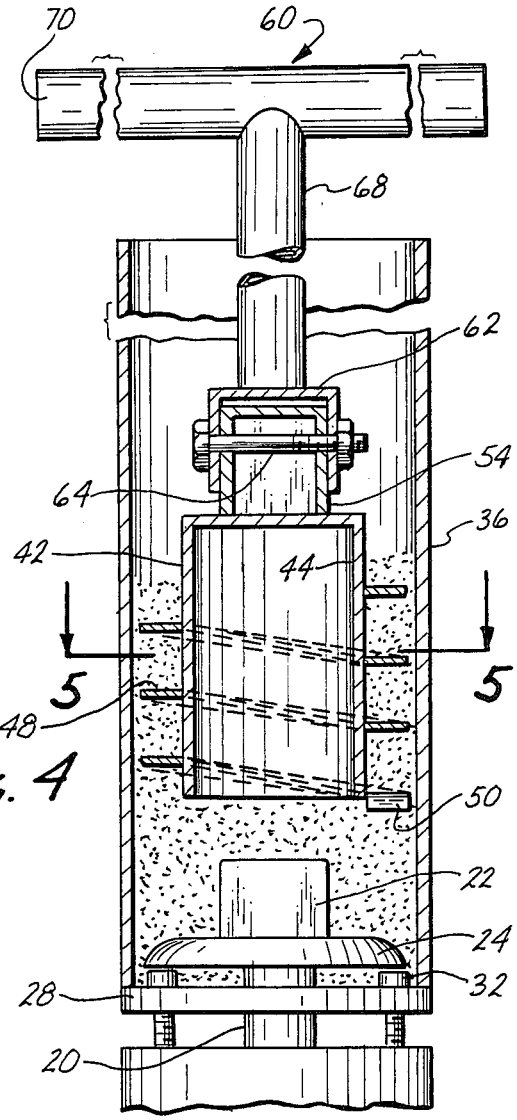
FIG. 4 is a cross-sectional view of the tool of FIG. 3, and the operating tool of FIG. 2, operating within a gate can.
Figure 5:
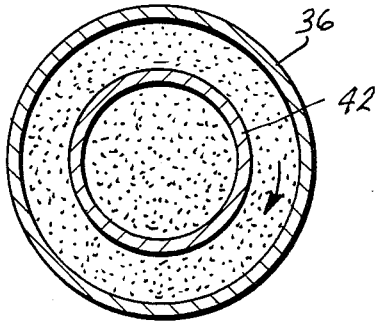
FIG. 5 is a cross-sectional view taken along the line 5—5 of FIG. 3.

As described in the foregoing, the maintenance crew wishing to gain access to the valve may find that the material within the gate can 36 has become so solidified that it cannot be extricated in the normal manner by using the tool of U.S. Pat. No. 4,601,077, which tool is shown in FIGS. 3, 4 and 5 herein and described hereinafter. It is to be realized that the gate can 36 may be a number of feet long, extending all the way to the surface. The herein invention provides an accessory tool, as shown in FIGS. 1 and 2, which has the capability of cutting into the solidified material and granulating or pulverizing it sufficiently so that the debris can be removed by the other tool, which will be referred to again presently.

The tool 9, as shown in FIGS. 1 and 2, includes a square fitting, designated at 11, having a transverse bore extending through it for attachment to the operating tool, as will be described. The part or fitting 11 is square. It has extending from it a straight, flat blade 14 which is secured along a diagonal of the square part 11, as shown. Thus, the blade 14 has more width than the width of a side of the square part 11. At the end of the blade 14 is a sharpened edge 15. The blade 14 is a preferred form for its purpose herein.

Numeral 60 in FIG. 2 designates a manual actuating or operating tool for operating or driving the tool 9 or the tool as shown in FIGS. 3, 4 and 5. This tool has a stem 68, at the lower end of which is a square socket 62 of a size to be received over the fitting 11 at the upper end of the tool 9, and it also can be received over the fitting 22 of the valve stem. This same tool is usable with the tool of FIGS. 3, 4 and 5. The socket 62 has a transverse bore 63, and numeral 64 designates a bolt that can fit through the bores 13 and 63 when the socket is in position over the fitting 11, as may be seen in FIG. 1.

Numeral 68 designates the stem extending vertically from the socket 62, having at its upper end the transverse operating handle 70. Typically, the stem 68 is extensible, that is, it is constructed in sections which can be joined together so as to provide for the necessary length to reach the surface with whatever gate can it is being utilized with.

FIG. 1 illustrates the manner in which the tool 9 is utilized. When the operating tool, as illustrated in FIG. 2, is attached to the fitting 11 of the tool 9 as described, it can be inserted down into the gate can 36 as illustrated in FIG. 1. In this manner, the solidified or relatively solidified material in the gate can 36 can be granulated or pulverized by moving the blade 14 downwardly into the material. The tool 9 may be operated by positioning the blade 14 across the center or center axis of the enclosure 36, and then when it is manually rotated while applying pressure, it will serve to break up the solidified material, that is, to granulate or pulverize the material or reduce it to particulate form in which the material can be readily removed by the tool, as illustrated in FIGS. 3, 4 and 5 and in U.S. Pat. No. 4,601,077.

If desired or necessary, the tool can be moved downwardly in the gate can 36 in a position offset from the center axis, if it may be necessary to grind up or particulate the material adjacent to the side walls of the disclosure. In this manner, the material within the enclosure 36 is broken up or granulated sufficiently for its removal all the way down to the fitting 22.

The tool as shown in FIGS. 3, 4 and 5 is the tool as described in detail in U.S. Pat. No. 4,601,077.

The tool is identified generally by the numeral 40 in FIGS. 3, 4, and 5. The tool includes a central cylindrical part 42 which has a bore 44 of a size such that it can come down over the fitting 22, as may be seen. Formed on the outside of this cylindrical part 42 is a helical rib 48. At the lower end of the rib 48 is a cutting edge 50 which is in substantially a radial position and at the bottom end of the cylindrical part 42. At the top of the cylindrical part 42 is a square fitting 54 which is of a size to be received in the square socket 62 at the end of the operating handle 68. The fitting 54 has a transverse bore through it to receive bolt 64.

FIG. 4 is a cross-sectional view showing the operating handle in position with the square socket 62 over the fitting 54 at the upper end of the tool 40 and bolted to it by the bolt 64. In FIG. 4, the closure or cap at the top end of the gate can 36 has been removed. This figure shows the tool in operating position. The tool is turned by hand by the operating handle at 70 so that the helix or auger 48 can cut into the pulverized or granulated silt, dirt, or other debris in the gate can. The tool can, of course, be lifted out of the gate can, carrying with it at the same time dirt or pulverized or granulated debris that has been loosened by way of tool 9 and is carried in between the convolutions of the helix as the tool is operated, and the debris within the gate can is removed. The tool, of course, moves downwardly in the enclosure, and when most or all of the debris has been removed, the lower end of the cylinder 42 will come down over the fitting 24, and the tool can then be removed entirely, and the operating handle 60 can be disengaged from the tool. Then, the operating tool 60 can have the stem 68 and the fitting, that is, the socket 62, extended down so that the socket fits over the fitting, that is, the square fitting 22, at the upper end of the valve stem 20. The valve can then be readily operated by the operating tool 60, either by way of closing it or opening it.

As can be seen from the foregoing, the same operating tool 60 as is used for the tool of FIGS. 1 and 2 is used for the tool of FIGS. 3, 4 and 5. This is the same tool that is used to engage the fitting 22 at the end of the valve stem.

It is to be observed accordingly that the process involves a series of steps which include both the tool of FIGS. 1 and 2 and the tool of FIGS. 3, 4 and 5 in circumstances where it has been found that the debris within the gate can 36 has become solidified. The tool of FIGS. 1 and 2 is first used in the gate can and manipulated or operated as described in the foregoing so as to granulate or pulverize the material in the gate can all the way down to the fitting 22. As explained, the operating steps may comprise operating this tool along the central axis of the gate can 36 or at positions displaced radially from this axis, if necessary. After the material has been sufficiently granulated or reduced to a particulate state, then the tool of FIGS. 3, 4 and 5 is used to capture the particulate material and remove it out of the gate can as already described and as described in U.S. Pat. No. 4,601,077.

It is to be seen from the foregoing that a method is provided in the form of a series of steps using the two different tools for successfully obtaining access to the end of a valve stem at the bottom of a gate can wherein the gate can contains material or debris that has become solidified.

Thus, a maintenance crew having the tools including the tool as shown in FIGS. 1 and 2 and the tool of FIGS. 3, 4 and 5 has available the means of obtaining access to the end of a valve stem in a gate can, even where the circumstances are such that the gate can is filled with solidified debris or other material.

The necessary tools include the tool of FIGS. 1 and 2 and that of FIGS. 3, 4 and 5 and the operating tool or instrumentality as shown in FIGS. 2 and 4, this same operating tool being used with both of the tools, that is, the tools of FIGS. 1 and 2 and the tool of FIGS. 3, 4 and 5, and this same operating tool being the one that is used to engage the fitting 22 at the end of the valve stem.

From the foregoing, it is to be observed that the invention provides a method which serves to achieve all of the objectives as set forth in the foregoing. Also, the invention provides the additional tool as shown in FIGS. 1 and 2.

With respect to the tool of FIGS. 1 and 2, the tool may be constructed in certain variant or equivalent forms. In the preferred form as shown, the tool provides a blade with a sharp edge which makes it possible to cut into the solidified material in the gate can. This can be accomplished by exerting limited downward force on the cutting edge of the blade, and then by rotating the operating tool, the blade can be rotated in a manner to granulate the solidified material and to reduce it to particulate form.

From the foregoing, those skilled in the art will readily understand the nature of the invention and the construction and operation of the tool and its utility. Those skilled in the art will readily recognize and appreciate the manner in which the tool achieves all of the objectives as set forth in the foregoing.

The foregoing disclosure is representative of a preferred form of the invention and is to be interpreted in an illustrative rather than a limiting sense, the invention to be accorded the full scope of the claims appended hereto.

What is claimed is:

1. A method of gaining access to a valve-operating stem, having an operating fitting at the end, of an underground value having a circular enclosure surrounding the operating end of the valve stem and extending to the surface, wherein the enclosure has become at least partially filled with a relatively solidfied material, the steps of inserting into the enclosure a tool having a rotatable blade capable of cutting into the partially solidified material and rotating the said blade so as to break up the solidified material in the enclosure; removing the said tool from the enclosure; inserting another tool into the enclosure and rotating the said other tool for collecting and holding the broken-up material in the enclosure; and the other tool having a cylindrical part having a bore of a size that it can come down over the fitting, the cylindrical part having on the outside and extending to the base thereof a helical rib for removing the dirt down below the end of said fitting withdrawing the said other tool and removing the collected and held broken-up material accumulated in the enclosure until access is had to the operating fitting at the end of the valve-operating stem, and inserting a tool engageable with the said operating fitting for turning the stem.

2. A method as in claim 1 including the step of exerting pressure on the first-mentioned tool having a blade for breaking up the solidified material in the enclosure.

3. A method as in claim 2 including the steps of inserting and rotating the first-mentioned tool in a position along the center line of the enclosure.

4. A method as in claim 2 including the step of inserting the first tool in a position off center of the enclosure.

5. A method of gaining access to a valve operating stem having an operating fitting at the end of an underground valve having a circular enclosure surrounding the operating end of the valve stem and extending to the surface wherein the enclosure has become at least partially filled with a relatively solidified material, the steps of inserting into the enclosure, a tool having a blade including at least one sharp edge capable of cutting into the partially solidifed material, rotting the said blade in a manner so as to break up the solidified material in the enclosure, removing the said first-mentioned tool from the enclosure, inserting another tool into the enclosure which is constructed for collecting and holding the broken-up material in the enclosure, rotating the said other tool embodying a part capable, upon being turned, of collecting and holding broken-up material in the enclsoure down to the operating stem, the other tool have a cylindrical part having a bore of a size that it can come down over the fitting, the cylindrical part having on the outside and extending to the base thereof a helical rib for removing the dirt down below the end of said fitting and withdrawing the said other tool and removing the broken-up material in the enclosure until access is had to the operating fitting at the end of the valve stem.

6. A method as in claim 5 including the step of forming the first-mentioned tool so as to have an extending blade positioned along a diameter of the enclosure for cutting into, and braking up, the solidified material and to be movable past the end of said stem, and inserting a tool engageable with the said operating fitting for turning the stem.

7. A method as in claim 5 including providing an operating tool having a fitting adapted for an operating connection to the first tool for operating it and adapted for connection to the other tool for operating it, and adapted as well for a connection to a fitting at the end of said valve stem.

8. A method as in claim 5 including forming the said blade as a flat member having a sharpened edge at its lower end.

9. A method as in claim 5 including forming the blade to extend from its operating fitting and to have at least one sharp edge at its end in a position to break up solidified material in the closure.

* * * * *